US012735285B2

(12) United States Patent
Nguyen

(10) Patent No.: US 12,735,285 B2
(45) Date of Patent: Sep. 15, 2026

(54) IMAGE FORMING APPARATUS

(71) Applicant: KYOCERA Document Solutions Inc., Osaka (JP)

(72) Inventor: Dong Ba Nguyen, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 19/264,273

(22) Filed: Jul. 9, 2025

(65) Prior Publication Data

US 2026/0015190 A1 Jan. 15, 2026

(30) Foreign Application Priority Data

Jul. 11, 2024 (JP) ..... 2024-111502

(51) Int. Cl.
*B65H 1/26* (2006.01)

(52) U.S. Cl.
CPC ..... *B65H 1/266* (2013.01); *B65H 2405/115* (2013.01); *B65H 2405/121* (2013.01); *B65H 2801/03* (2013.01)

(58) Field of Classification Search
CPC .... B65H 1/266; B65H 1/04; B65H 2405/121; B65H 2405/115
See application file for complete search history.

(56) References Cited

U.S. PATENT DOCUMENTS 5,294,106 A * 3/1994 Takagi ..... B65H 1/04 271/164
7,731,180 B2 * 6/2010 Ohnishi ..... B65H 1/266 271/145
8,428,506 B2 * 4/2013 Miki ..... G03G 15/6502 292/341.15
8,899,576 B2 * 12/2014 Doshida ..... B65H 3/0684 271/145
9,102,489 B2 * 8/2015 Uohashi ..... B65H 1/027
9,718,631 B2 * 8/2017 Eguchi ..... B65H 1/04
(Continued)

FOREIGN PATENT DOCUMENTS

JP 2006-008291 A 1/2006
JP 2008-239328 A 10/2008
(Continued)

OTHER PUBLICATIONS

Extended European Search Report issued in EP 25186498.9-1001 by the European Patent Office on Dec. 4, 2025.

*Primary Examiner* — Patrick Cicchino
(74) *Attorney, Agent, or Firm* — Studebaker Brackett PLLC

(57) ABSTRACT

An image forming apparatus includes a sheet feeding cassette which is housed in an apparatus main body in a retractable manner, and a locking mechanism which restricts and releases a pulling out of the sheet feeding cassette from the apparatus main body. The sheet feeding cassette includes an outer cover, and a handle. The outer cover has a recess on an outer surface. The handle is housed in the recess so as to be turned outside from the outer surface, and turned outside by being gripped when the sheet feeding cassette is pulled out from the apparatus main body. The locking mechanism restricts and releases the pulling out of the sheet feeding cassette from the apparatus main body in conjunction with the turning of the handle.

4 Claims, 12 Drawing Sheets

(56) References Cited

U.S. PATENT DOCUMENTS

| | | | | |
|---|---|---|---|---|
| 10,179,713 | B2 * | 1/2019 | Kuno | B65H 1/04 |
| 11,618,643 | B2 * | 4/2023 | Kamichi | G03G 15/6502 271/162 |
| 12,071,316 | B2 * | 8/2024 | Shiraishi | B65H 1/266 |
| 12,625,458 | B2 * | 5/2026 | Yamamoto | G03G 15/6502 |
| 2008/0237972 | A1 | 10/2008 | Ohnishi | |
| 2019/0300305 | A1 | 10/2019 | Nakanosono | |

FOREIGN PATENT DOCUMENTS

| | | | | |
|---|---|---|---|---|
| JP | 2019-172462 | A | 10/2019 | |
| JP | 7230605 | B2 * | 3/2023 | A47B 88/467 |

* cited by examiner

IMAGE FORMING APPARATUS

INCORPORATION BY REFERENCE

This application is based on and claims the benefit of priority from Japanese patent application No. 2024-111502 filed on Jul. 11, 2024, which is incorporated by reference in its entirety.

TECHNICAL FIELD

The present disclosure relates to an image forming apparatus provided with a sheet feeding cassette stored in an apparatus main body in a retractable manner.

BACKGROUND

The image forming apparatus is provided with a sheet feeding cassette stored in an apparatus main body in a retractable manner. In such an image forming apparatus, if the sheet feeding cassette is pulled out from the apparatus main body by mistake during the image forming operation, the image forming operation is interrupted, the sheet conveyance is stopped, and there is a possibility that a sheet jam occurs. For this reason, the image forming apparatus may be provided with a locking mechanism for restricting the pulling out of the sheet feeding cassette.

Such a locking mechanism may be configured so as to be interlocked with, for example, the operation of a handle held when the sheet feeding cassette is pulled out.

The storage cassette (corresponding to the sheet feeding cassette) may be provided with a handle movable forward in the pulling out direction, and a locking mechanism for restricting pulling out of the sheet feeding from cassette the cassette support (corresponding to the apparatus main body) using magnetic force. By pulling the handle forward at the time of pulling out, the restriction of pulling out of the sheet feeding cassette by the locking mechanism is released.

The sheet feeding cassette may be provided with a handle having a fixed grip portion and a movable grip portion movable forward in the pull-out direction relative to the fixed grip portion. When the handle is gripped at the time of pulling out, the movable grip portion moves with respect to the fixed grip portion, thereby releasing the restriction of pulling out of the sheet feeding cassette by the locking mechanism.

However, the above-described locking mechanisms operates the locking mechanism to restrict or release the pulling out of the sheet feeding cassette by moving the handle or the movable grip portion forward. In order to reliably operate the locking mechanism, it is necessary to make the moving space of the handle and the movable grip portion relatively long. Therefore, the handle protrudes from the front surface of the storage cassette, and the size (depth) of the handle increases.

SUMMARY

An image forming apparatus according to the present disclosure includes a sheet feeding cassette which is housed in an apparatus main body in a retractable manner, and a locking mechanism which restricts and releases a pulling out of the sheet feeding cassette from the apparatus main body. The sheet feeding cassette includes an outer cover, and a handle. The outer cover has a recess on an outer surface. The handle is housed in the recess so as to be turned outside from the outer surface, and turned outside by being gripped when the sheet feeding cassette is pulled out from the apparatus main body. The locking mechanism restricts and releases the pulling out of the sheet feeding e from the apparatus main body in conjunction with the turning of the handle.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming apparatus according to one embodiment of the present disclosure will be described.

Figure 1:
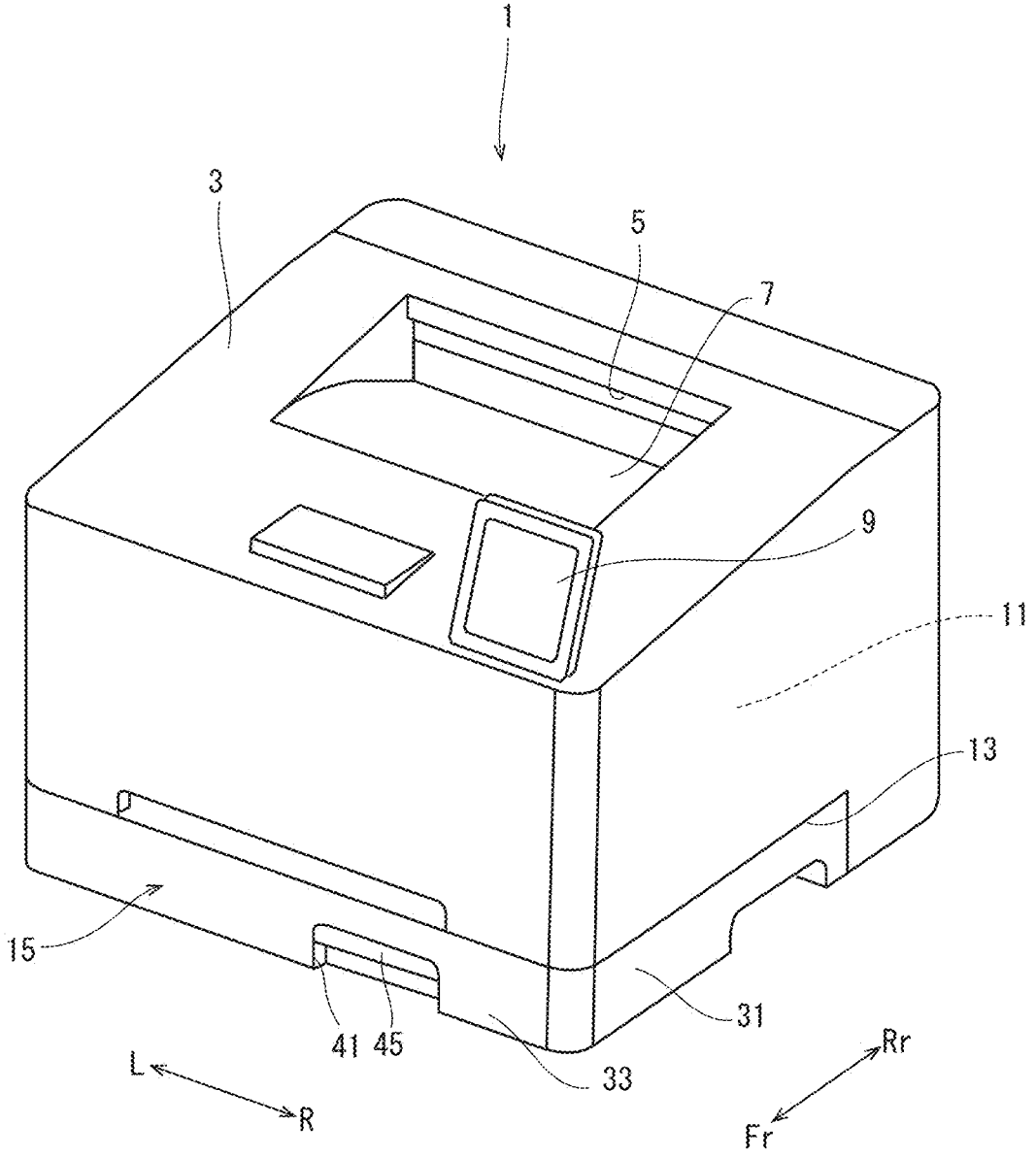
FIG. 1 is a perspective view showing an image forming apparatus according to one embodiment of the present disclosure.

First, the entire configuration of the image forming apparatus 1 will be described with reference to FIG. 1. FIG. 1 is a perspective view showing the image forming apparatus 1 according to the embodiment of the present disclosure. Fr, Rr, L, R, Up, and Lo in each figure indicate the front side, rear side, left side, right side, upper side, and lower side of the image forming apparatus 1, respectively.

The image forming apparatus 1 includes an apparatus main body 3 having left and right side plates, front and rear side plates, a top plate, and a bottom plate, and having a substantially rectangular parallelepiped internal space. A discharge port 5 through which a sheet is discharged is formed on the top plate. On the upper surface of the top plate, a discharge tray 7 on which the sheet discharged through the discharge port 5 is formed in front of the discharge port 5. Further, on the upper surface of the top plate, there is provided an operation panel 9 for inputting execution of image forming operation.

In the internal space of the apparatus main body 3, an image forming part 11 which forms an image on the sheet is housed. A cassette housing part 13 is formed below the image forming part 11. In the cassette housing part 13, a sheet feeding cassette which stores the sheet on which an image is to be formed by the image forming part 11 is housed. The sheet feeding cassette 15 can be pulled out forward from the cassette housing part 13 through an opening 21 (see FIG. 2 and FIG. 3) formed in the front side plate 3*a*. That is, in this example, the pulling out direction of the sheet feeding cassette 15 is the front direction.

When the sheet feeding cassette 15 is housed in the cassette housing part 13 and execution of the image forming operation is inputted to the operation panel 9, the sheet is fed from the sheet feeding cassette 15, and an image is formed on the sheet in the image forming part 11. The sheet on which the image is formed is discharged through the discharge port 5 and loaded on the discharge tray 7.

A locking mechanism 17 (see FIG. 2 and FIG. 3) is provided on the cassette housing part 13 and the sheet feeding cassette 15, which restricts the pulling out of the sheet feeding cassette 15 from the cassette housing part 13.

Figure 2:
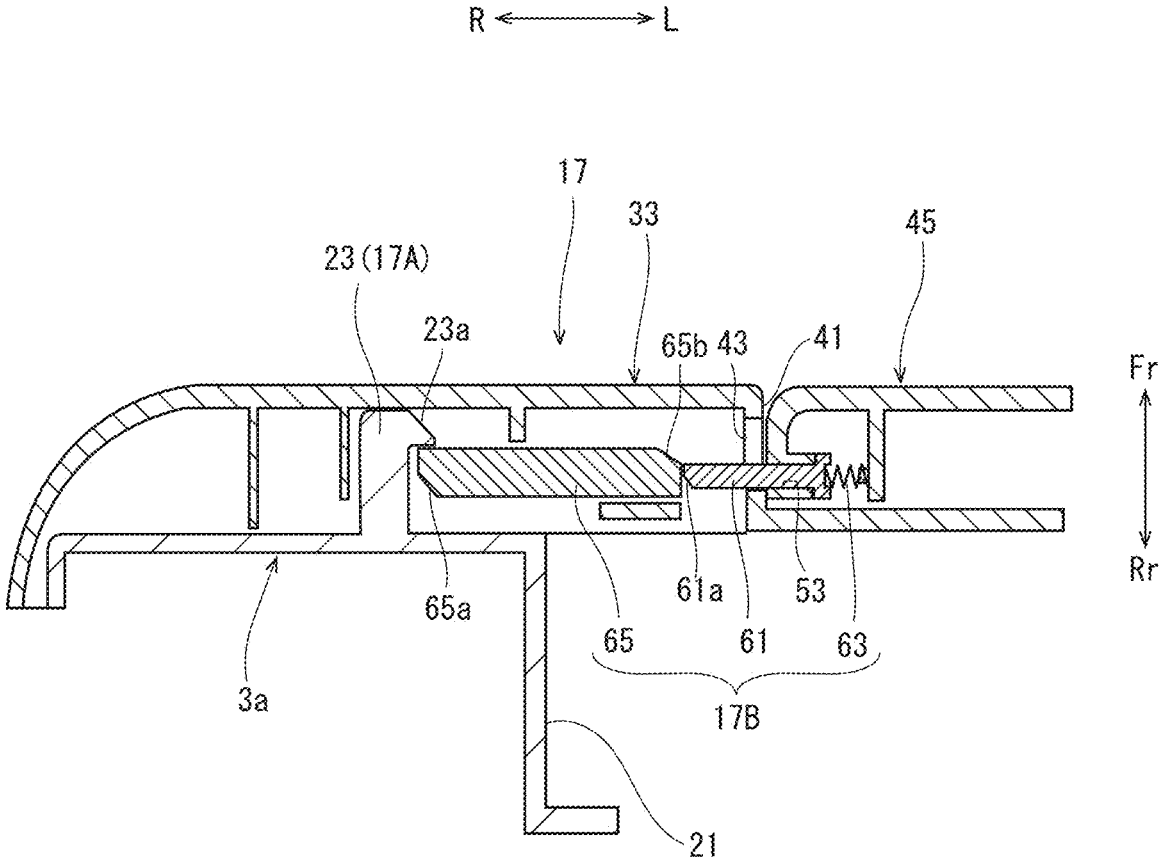
FIG. 2 is a cross-sectional view showing a locking mechanism, viewed from the upper side, in the image forming apparatus according to the embodiment of the present disclosure.
Figure 3:
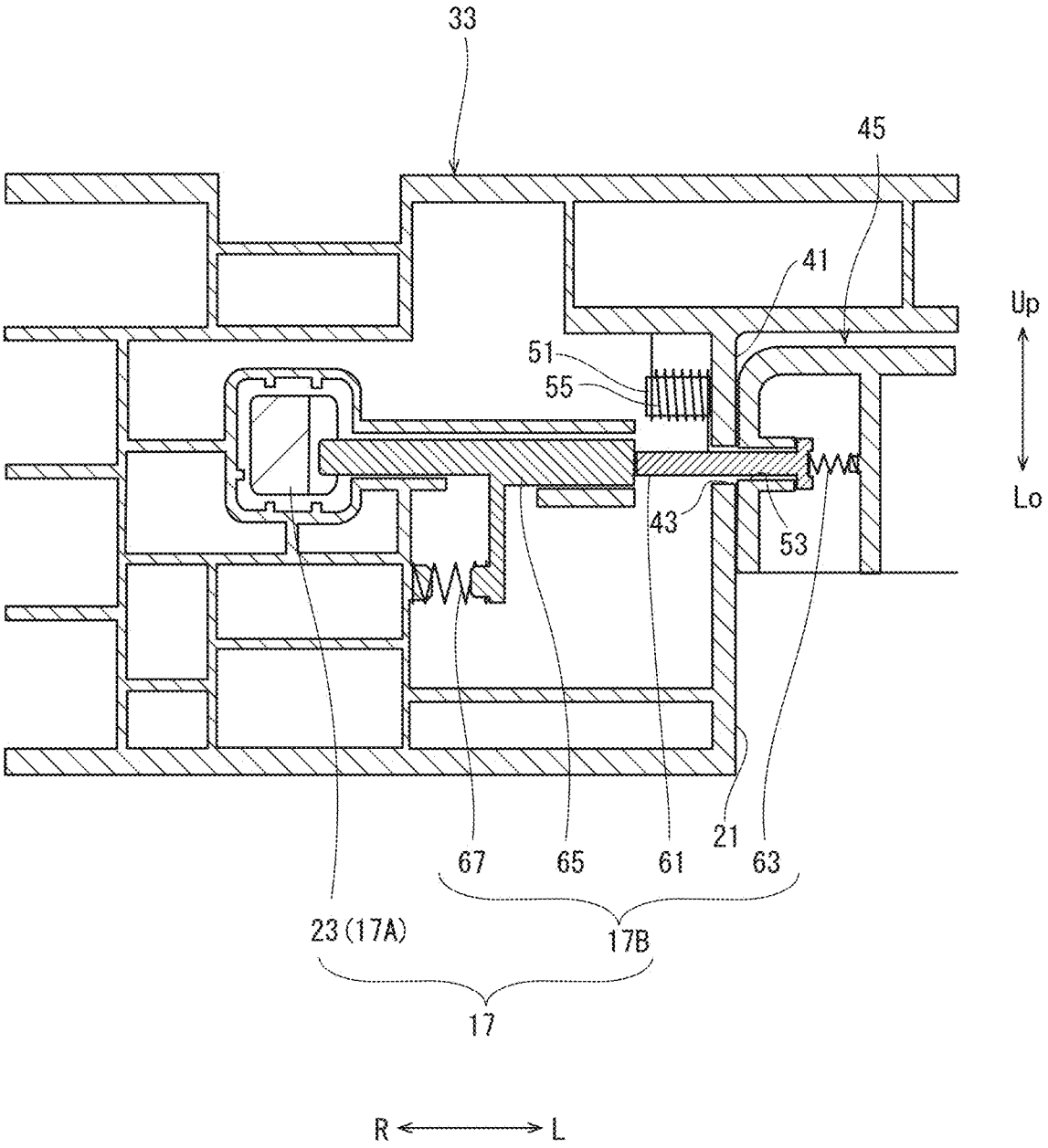
FIG. 3 is a cross-sectional view showing the locking mechanism, viewed from the rear side, in the image forming apparatus according to the embodiment of the present disclosure.

The locking mechanism 17 will be described with reference to FIG. 2 and FIG. 3. FIG. 2 is a cross-sectional view showing the locking mechanism 17 viewed from the upper side, and FIG. 3 is a cross-sectional view showing the locking mechanism 17 viewed from the rear side. The locking mechanism 17 includes a main body side locking mechanism 17A provided in the cassette housing part 13 (the apparatus main body 3) and a cassette side locking mechanism 17B provided in the sheet feeding cassette 15.

First, the main body side locking mechanism 17A will be described. The main body side locking mechanism 17A is an engagement portion 23 provided on the front side plate 3*a* of the apparatus main body 3. The engagement portion 23 is disposed on the right side of the opening 21 communicating with the cassette housing part 13, and protrudes forward. The engagement portion 23 has a base part extending forward from the front surface of the front side plate 3*a* and a claw portion bent leftward from the front end of the base part. The claw portion has a tapered shape, and the front surface is an inclined surface 23*a* inclined rearward toward the left side (toward the opening 21) (toward the rear side of the apparatus main body 3).

Figure 4:
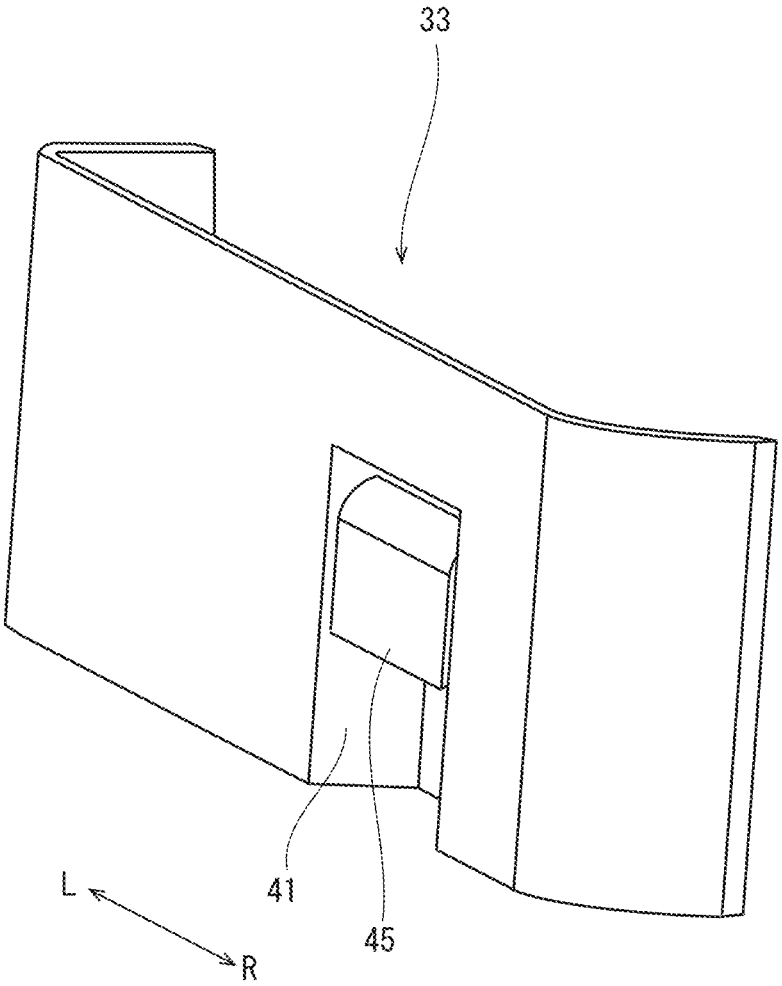
FIG. 4 is a perspective view showing an outer cover of a sheet feeding cassette in the image forming apparatus according to the embodiment of the present disclosure.
Figure 5:
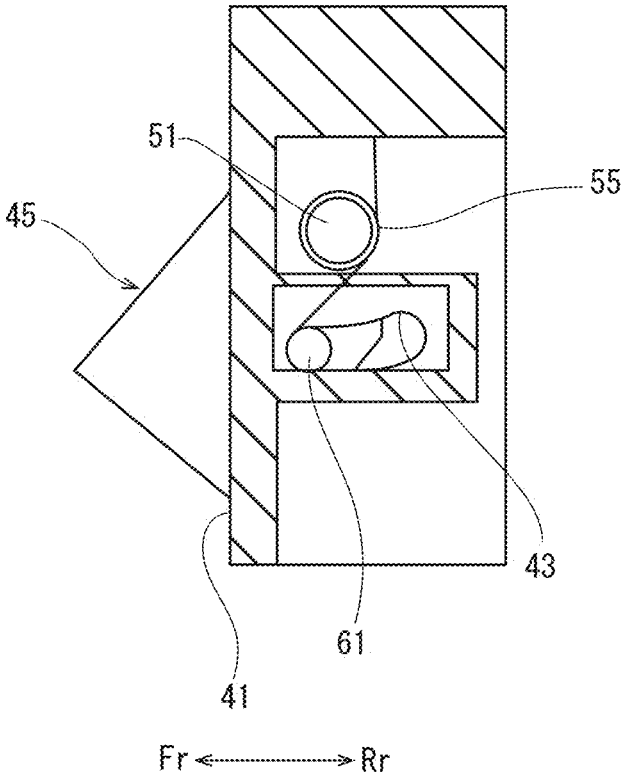
FIG. 5 is a side view showing a handle of the sheet feeding cassette in the image forming apparatus according to the embodiment of the present disclosure.
Figure 6:
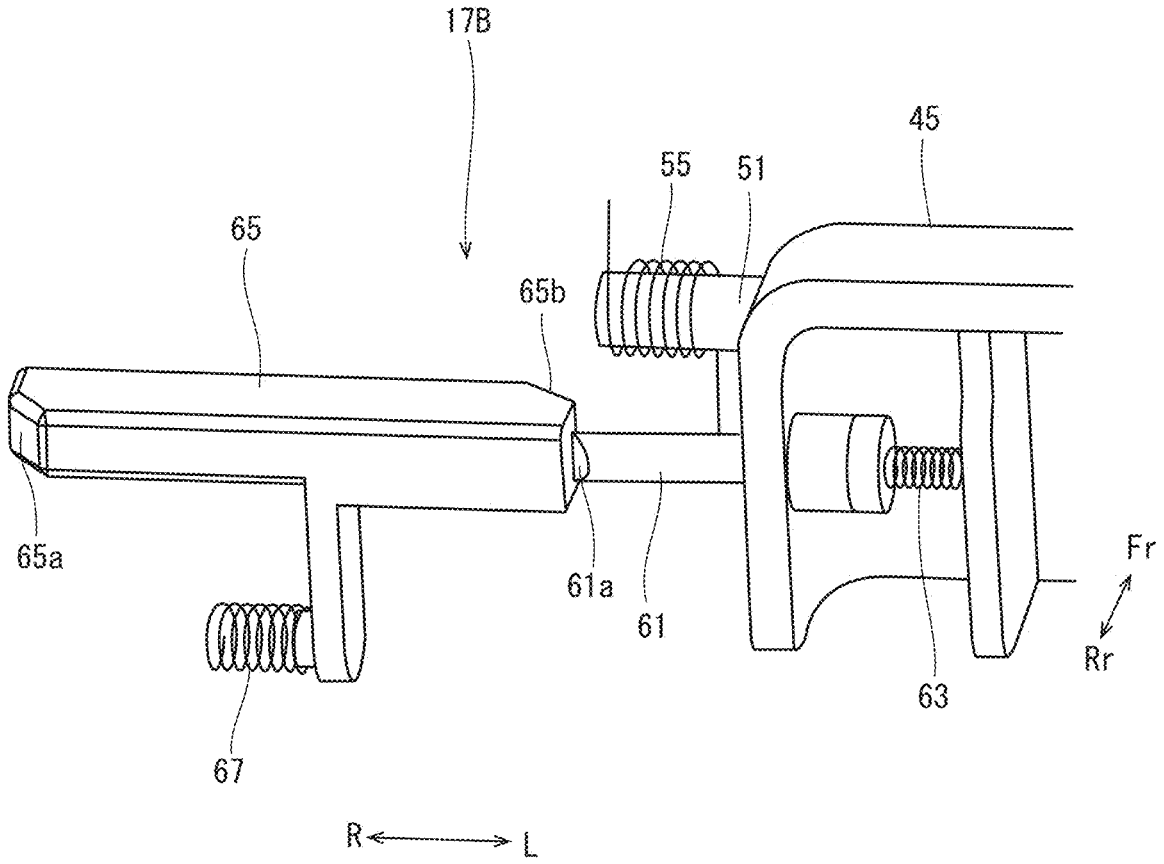
FIG. 6 is a perspective view showing a cassette side locking mechanism of the locking mechanism in the image forming apparatus according to the embodiment of the present disclosure.

Next, the cassette side locking mechanism 17B will be described with reference to FIG. 1 to FIG. 3 and FIG. 4 to FIG. 6. FIG. 4 is a perspective view showing an outer cover 33, FIG. 5 is a side view showing a handle 45, and FIG. 6 is a perspective view showing the cassette side locking mechanism 17B. As shown in FIG. 6, the cassette side locking mechanism 17B includes a pin 61 and a pin biasing member 63 supported by the handle 45, and a lock member 65 and a lock biasing member 67 supported by the outer cover 33.

First, the sheet feeding cassette 15 will be described. As shown in FIG. 1, the sheet feeding cassette 15 has a main body 31 whish stores the sheet and the outer cover 33. When the sheet feeding cassette 15 is housed in the cassette housing part 13, the outer cover 33 overlaps the front side plate 3*a* of the apparatus main body 3 and covers the opening 21.

As shown in FIG. 4, a recess 41 is formed on the right end portion of the outer surface (the front surface) of the outer cover 33. The recess 41 has right and left side surfaces, an upper surface, and a rear surface (a bottom surface), and a lower surface is open. Downward arc-shaped slits 43 (see FIG. 5) are formed in the left and right side surfaces. A handle 45 is housed in the recess 41.

The handle 45 has a height lower than a height of the recess 41, has a horizontally long rectangular front plate and an upper plate, and a vertically long substantially rectangular right and left side plate, and is formed in a hollow shape with the lower surface and the rear surface open. A plurality of ribs parallel to the right and left side plates are formed in the hollow space. As shown in FIG. 5 and FIG. 6, left and right rotational shafts 51 protruding in opposite directions along the left-and-right direction are formed at upper end portions of the outer surfaces of the left and right side plates. Further, in the right side plate, a through-hole 53 (see FIG. 2 and FIG. 3) penetrating in the left-and-right direction is formed below the right rotational shaft 51.

As shown in FIG. 4, the handle 45 is housed in the recess 41 of the outer cover 33. As shown in FIG. 5, the left and right rotational shafts 51 are rotatably supported at upper end portions of the left and right side surfaces of the recess 41. As a result, the handle 45 can be turned forward (see FIG. 5) from the housing posture housed in the recess 41 (see FIG. 4). A rotational angle is 45 degrees in one example. In the housing posture, a space is formed below the handle 45. By inserting a finger into the hollow space of the handle 45 through this space, the finger can be placed on the handle 45. When the finger is placed on the handle 45 and the handle 45 is pulled forward as it is, the handle 45 is turned outward from the outer cover 33 around the rotational shafts 51, thereby widening the gap between the handle 45 and the bottom surface of the recess 41. As will be described later, the handle 45 is biased to the housing posture by a torsion coil spring 55 externally fitted around the right rotational shaft 51.

Next, the pin 61 will be described. The pin 61 has a disk-shaped head portion and a cylindrical shaft portion. A half of the tip end surface of the shaft portion is an obliquely notched inclined surface 61*a*. As shown in FIG. 2 and FIG. 3, the pin 61 is inserted into the through-hole 53 formed in the right side plate of the handle 45. More specifically, the pin 61 is inserted into the through-hole 53 from the inside of the right side plate with the shaft portion forward in a posture in which the inclined surface 61*a* of the shaft portion faces rearward. As shown in FIG. 2 and FIG. 3, the shaft portion protruding through the through-hole 53 protrudes on the rear side of the outer cover 33 through the slit 43 formed on the right side surface of the recess 41 of the outer cover 33. When the handle 45 is turned forward from the housing posture, the pin 61 moves forward in the slit 43 together with the handle 45 (see FIG. 5). As described above, the protruding direction of the pin 61 is the right direction in this example, and intersects with the pulling out direction (the front direction) of the sheet feeding cassette 15.

As shown in FIG. 3, FIG. 5 and FIG. 6, the coil portion of the torsion coil spring 55 is externally fitted around the right rotational shaft 51 protruding from the right side plate of the recess 41, as described above. One arm portion of the torsion coil spring 55 is fixed to the outer cover 33, and the other arm portion abuts on the shaft portion of the pin 61 protruding from the right side plate of the recess 41 from the front side. In this manner, the torsion coil spring 55 biases the handle 45 to the housing posture.

Next, a coil spring as the pin biasing member 63 will be described. As shown in FIG. 6, the coil spring 63 is disposed between the head portion of the pin 61 and the rib provided in the hollow space of the handle 45. The coil spring 63 biases the pin 61 rightward (the protruding direction) until the head portion of the pin 61 abuts on the right side plate of the handle 45.

Next, the lock member 65 will be described. The lock member 65 has a body part having a horizontal rectangular columnar shape and a leg part having a vertical rectangular parallelepiped shape, and has a T-shape when viewed from the front side. As shown in FIG. 6, an obliquely notched rear inclined surface 65*a* is formed on the rear half of the right end surface of the body part, and an obliquely notched front inclined surface 65*b* is formed on the front half of the left end surface.

As shown in FIG. 2 and FIG. 3, the lock member 65 is disposed on the right side of the pin 61, and supported on the rear surface of the outer cover 33 so as to be movable in the left-and-right direction. In the state where the handle 45 is turned in the housing posture, the body part of the lock member 65 is aligned with the pin 61 in the left-and-right direction, and the left end surface of the body part faces the tip end surface of the pin 61. On the other hand, when the handle 45 is turned outward from the housing posture, the body part is separated from the pin 61 forwardly.

When the lock member 65 is moved rightward while the sheet feeding cassette 15 is housed in the cassette housing part 13, as shown in FIG. 2 and FIG. 3, the lock member 65 engages with the engagement portion 23 formed on the front side plate 3*a* of the apparatus main body 3. That is, the right end portion of the lock member 65 moves on the rear side of the claw portion of the engagement portion 23, and the right end portion of the lock member 65 and the claw portion of the engagement portion 23 overlap in the front-and-rear direction. As a result, the pulling out of the sheet feeding cassette 15 from the cassette housing part 13 (the apparatus main body 3) is restricted.

Next, the coil spring as the lock biasing member 67 will be described. As shown in FIG. 3 and FIG. 6, the coil spring 67 is disposed between the leg part of the lock member 65 and a rib formed on the rear surface of the outer cover 33. The coil spring 67 biases the lock member 65 leftward, that is, in a direction opposite to the protruding direction (rightward) of the pin 61.

A biasing force of the coil spring 67 for biasing the lock member 65 is smaller than a biasing force of the coil spring 63 for biasing the pin 61. Accordingly, in the state where the handle 45 is turned in the housing posture, the pin 61 is biased by the coil spring 63 to push the lock member 65 rightward. The lock member 65 is pushed by the pin 61, and moved rightward against the biasing force of the coil spring 67.

With reference to FIGS. 2 and 3 and FIG. 7 to FIG. 12, an operation of restricting the pulling out of the sheet feeding cassette 15 from the cassette housing part 13 and an operation of releasing the restriction by the locking mechanism 17 in the image forming apparatus 1 having the above configuration. FIG. 7 to FIG. 12 are views explaining the operation of the locking mechanism 17.

First, the state in which the sheet feeding cassette 15 is housed in the cassette housing part 13 will be described. In this state, as shown in FIG. 2 and FIG. 3, the pin 61 is biased by the coil spring 63 to push the lock member 65 rightward. The lock member 65 is pushed by the pin 61, and moved rightward against the biasing force of the coil spring 67. Thus, the lock member 65 is engaged with the engagement portion 23 of the apparatus main body 3, and the pulling out of the sheet feeding cassette 15 from the cassette housing part 13 is restricted.

Figure 7:
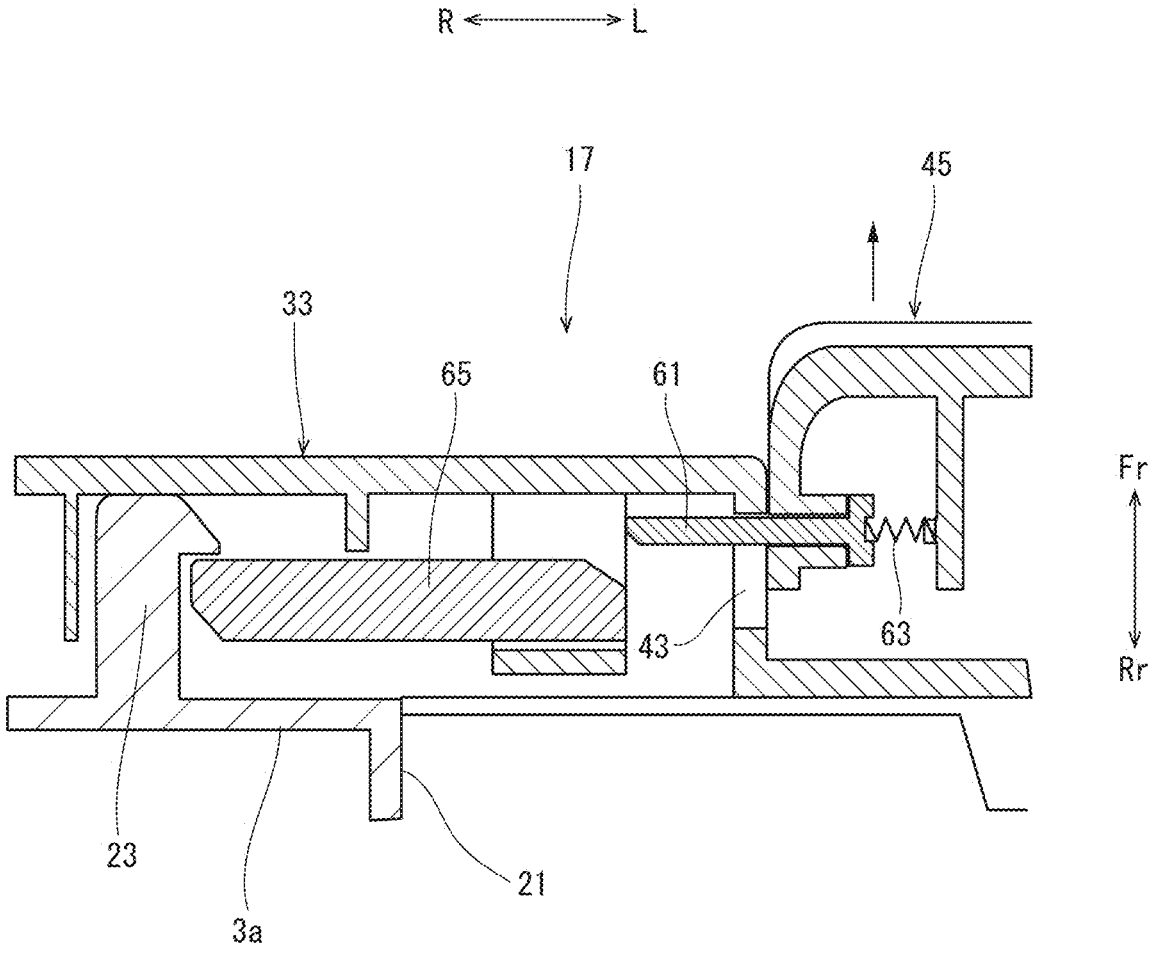
FIG. 7 is a cross-sectional view showing the locking mechanism (in a state in which a handle is held) viewed from the upper side, in the image forming apparatus according to the embodiment of the present disclosure.

Next, a case in which the sheet feeding cassette 15 is pulled out from the cassette housing part 13 will be described. First, as shown in FIG. 7, a finger is placed on the handle 45 and turns the handle 35 forward (see the arrow in FIG. 7). Then, the pin 61 is moved forward in the slit 43 in accordance with the turning of the handle 45 (see also FIG. 5), and the pin 61 is separated from the lock member 65 forward.

Figure 8:
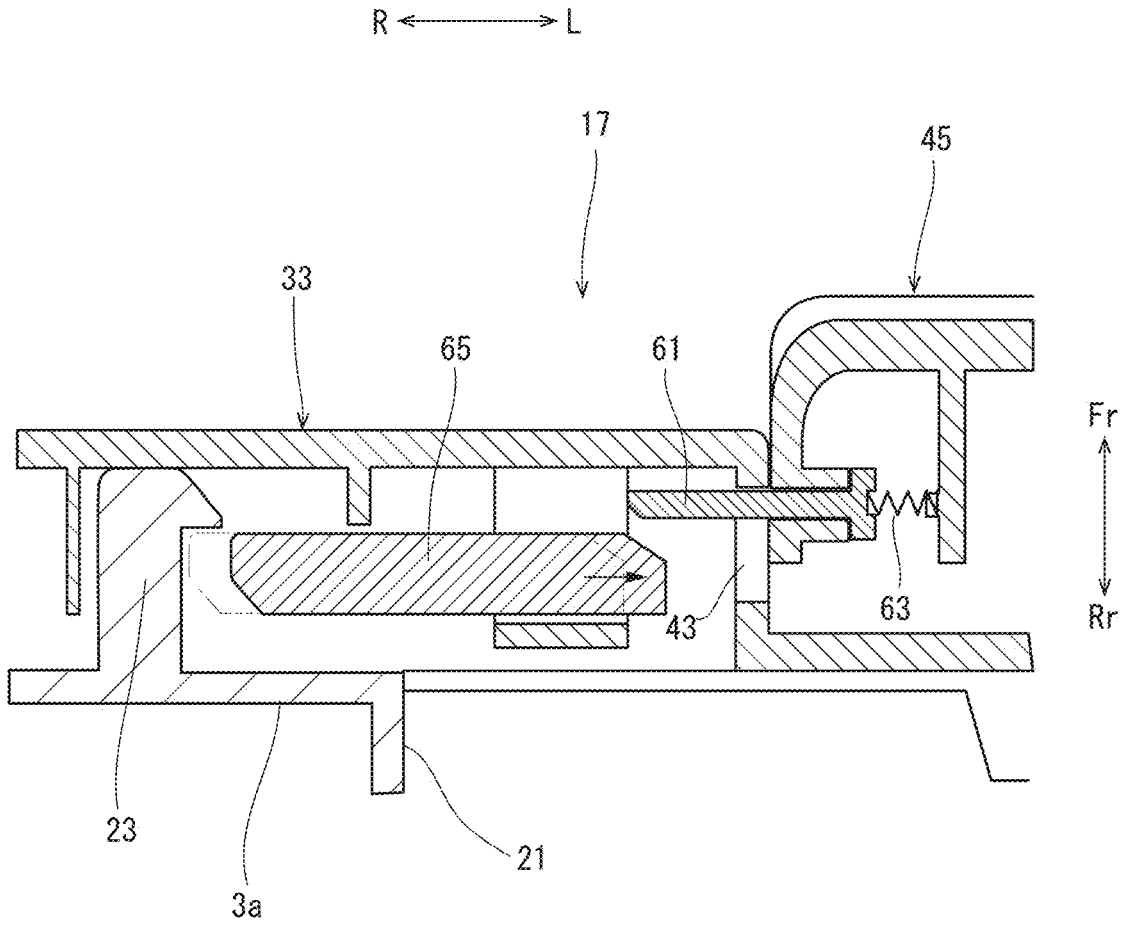
FIG. 8 is a cross-sectional view showing the locking mechanism (in a state in which engagement between a lock member and an engagement portion is released) viewed from the upper side, in the image forming apparatus according to the embodiment of the present disclosure.
Figure 9:
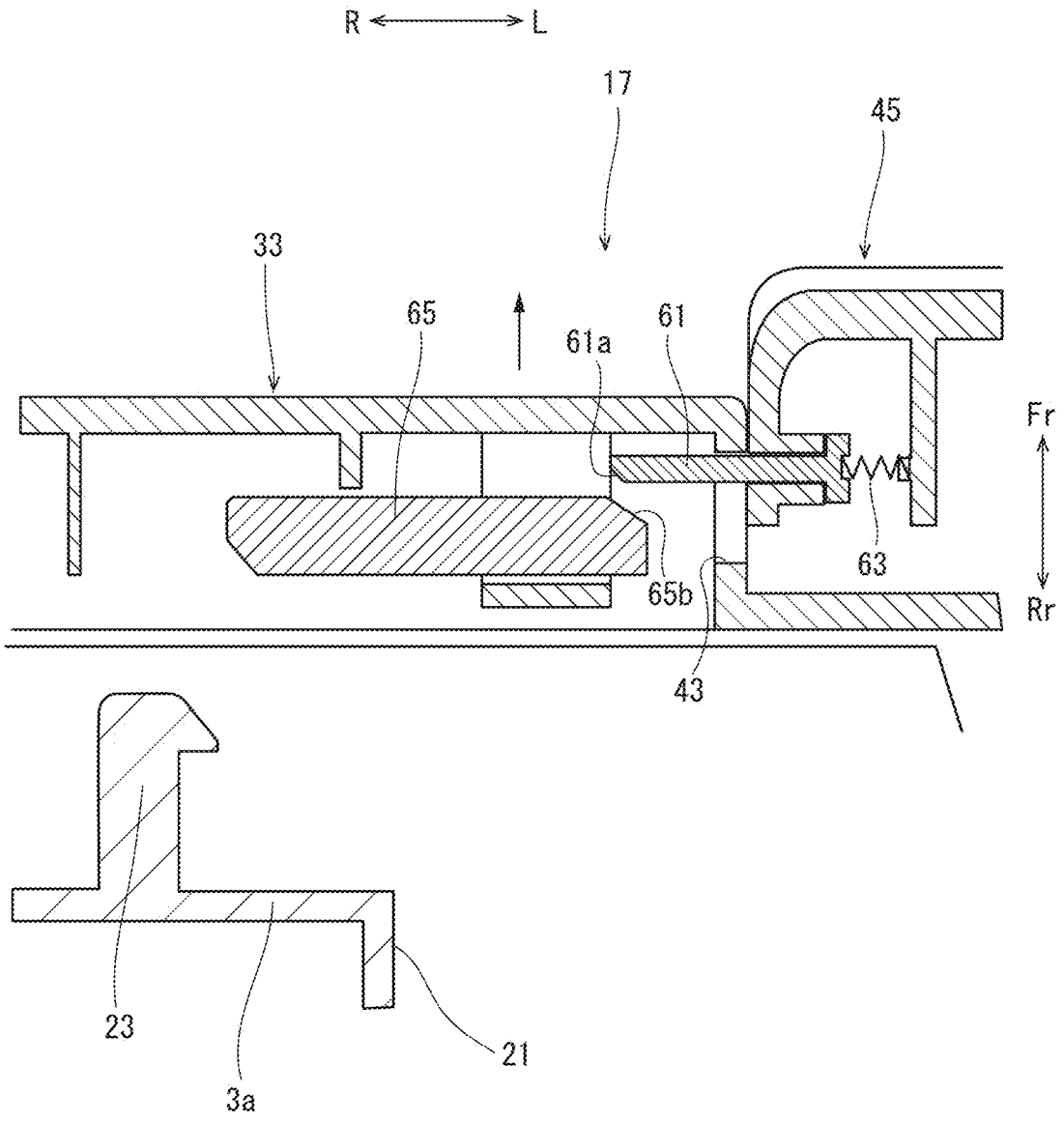
FIG. 9 is a cross-sectional view showing the locking mechanism (in a state in which the sheet feeding cassette is pulled out) viewed from the upper side, in the image forming apparatus according to the embodiment of the present disclosure.

Then, as shown in FIG. 8, the lock member 65 is biased by the coil spring 67 and moved leftward (see the arrow in FIG. 8), so that the right end portion of the lock member 65 and the claw portion of the engagement portion 23 do not overlap in the front-and-rear direction. Then, the engagement between the lock member 65 and the engagement portion 23 is released. As a result, the restriction of pulling out of the sheet feeding cassette 15 from the cassette housing part 13 is released. Thereafter, as shown in FIG. 9, the sheet feeding cassette 15 is pulled out forward from the cassette housing part 13 while the finger is placed on the handle 45 (see the arrow in FIG. 9).

Figure 10:
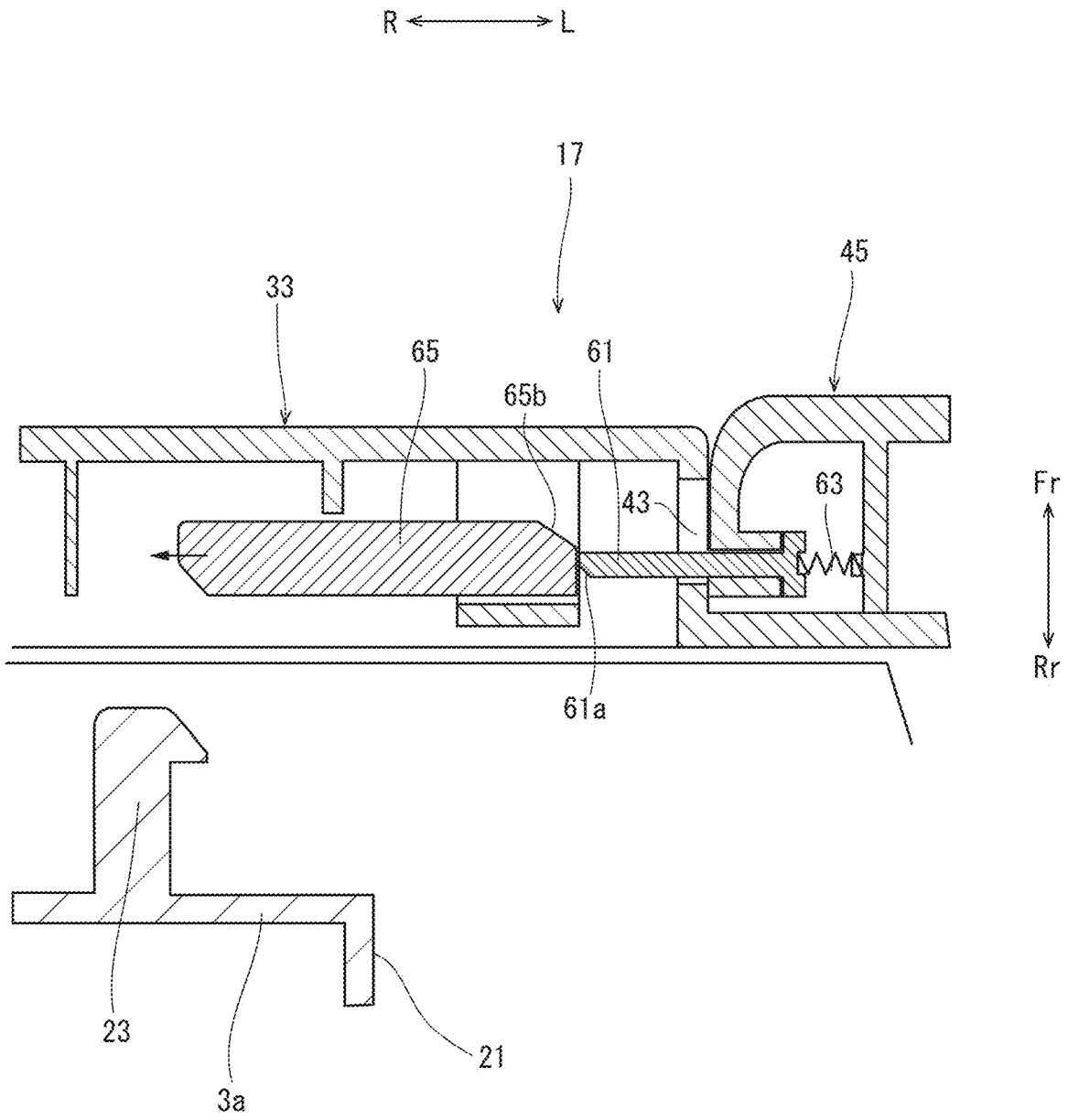
FIG. 10 is a cross-sectional view showing the locking mechanism (in a state in which the handle is stored in a recess) viewed from the upper side, in the image forming apparatus according to the embodiment of the present disclosure.

Thereafter, when the finger is released from the handle 45, as shown in FIG. 10, the handle 45 is biased by the torsion coil spring 55 and turned to the housing posture. At this time, the pin 61 is moved rearward together with the handle 45, and the inclined surface 61*a* of the pin 61 abuts on the front inclined surface 65*b* of the lock member 65. The pin 61 is biased rightward by the coil spring 63. The biasing force of the coil spring 63 for biasing the pin 61 is larger than the biasing force of the coil spring 67 for biasing the lock member 65. Accordingly, the lock member 65 is guided rightward along the inclined surfaces 61*a* and 65*b* against the biasing force of the coil spring 67. As a result, the lock member 65 is moved rightward (see the arrow in FIG. 10).

Figure 11:
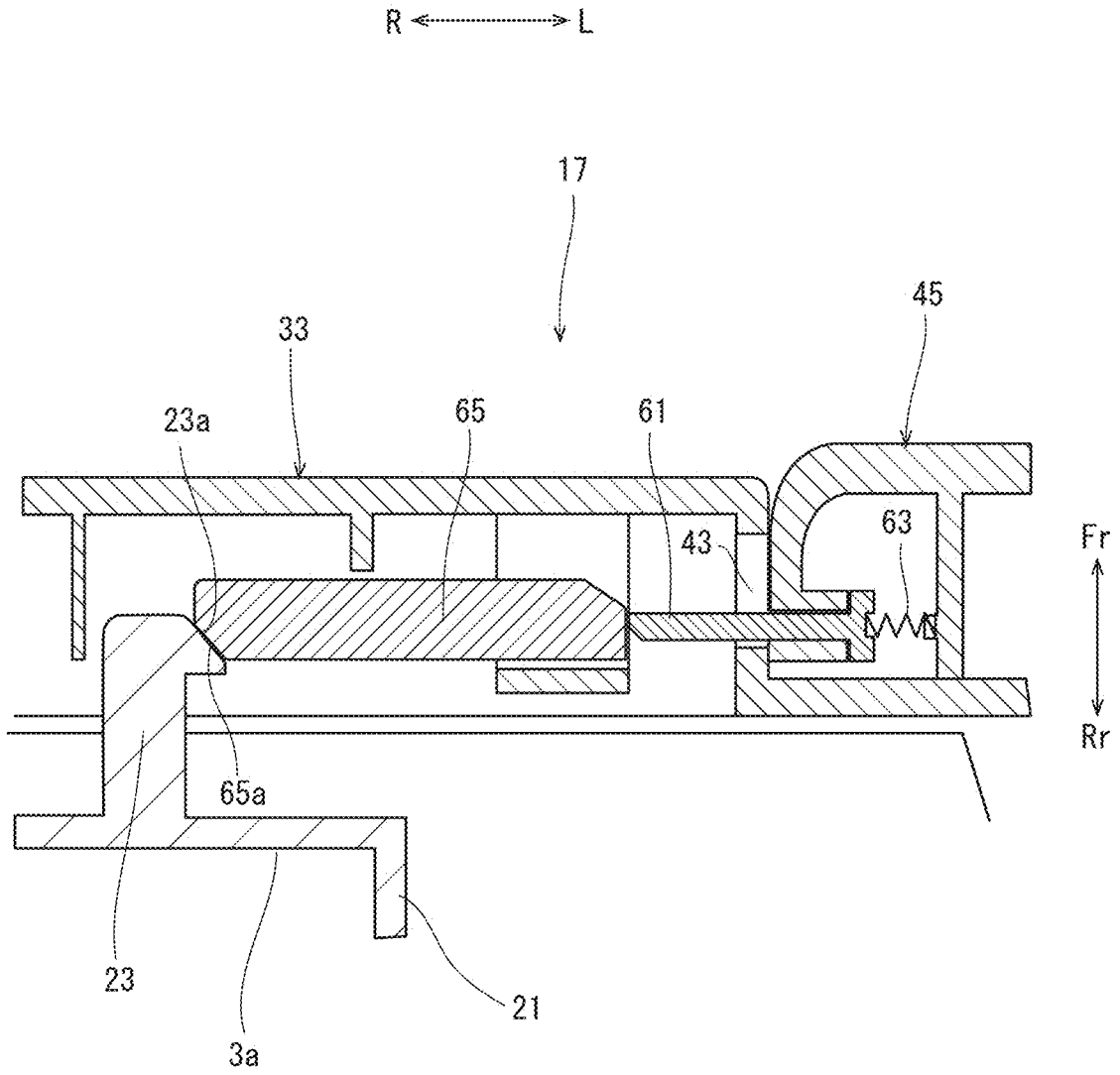
FIG. 11 is a cross-sectional view showing the locking mechanism (in a state in which the lock member abuts against the engagement portion) viewed from the upper side, in the image forming apparatus according to the embodiment of the present disclosure.

Next, a case where the sheet feeding cassette 15 is housed in the cassette housing part 13 will be described. When the sheet feeding cassette 15 is pushed into the cassette housing part 13, as shown in FIG. 11, the rear inclined surface 65*a* of the lock member 65 abuts against the inclined surface 23*a* of the engagement portion 23.

Figure 12:
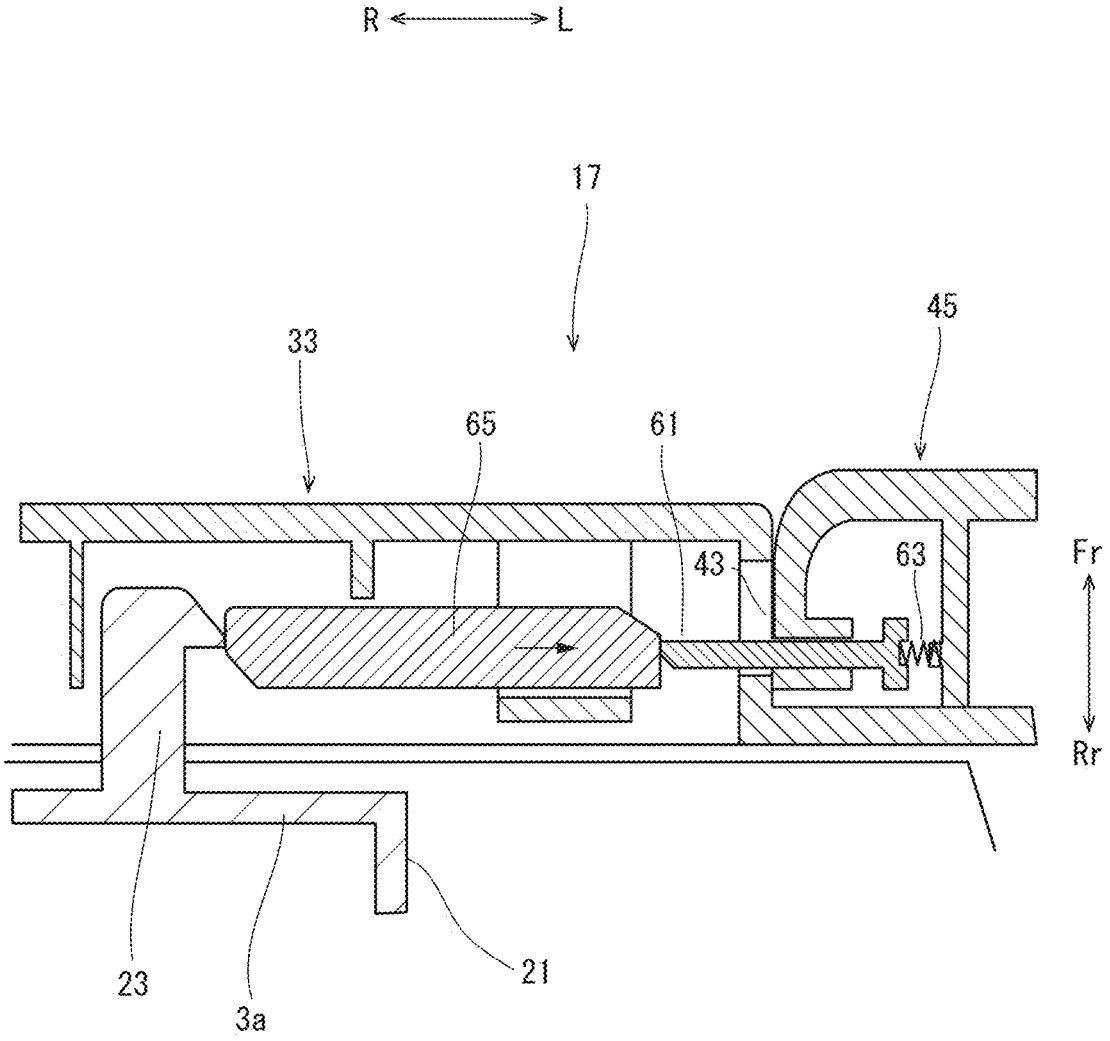
FIG. 12 is a cross-sectional view showing the locking mechanism (in a state in which a pin is pushed through the lock member) viewed from the upper side, in the image forming apparatus according to the embodiment of the present disclosure.

When the sheet feeding cassette 15 is further pushed in, the lock member 65 is guided along the inclined surfaces 65*a* and 23*a* and moved leftward. At this time, as shown in FIG. 12, the pin 61 is also pushed leftward by the lock member 65 and moved leftward against the biasing force of the coil spring 63 (see the arrow in FIG. 12).

When the sheet feeding cassette 15 is pushed further and the lock member 65 is moved on the rear side of the claw portion of the engagement portion 23, the lock member 65 is biased rightward by the coil spring 63 through the pin 61, and engaged with the engagement portion 23 (see FIG. 2 and FIG. 3).

As described above, according to the present disclosure, the locking mechanism 17 is operated by the operation of turning the handle 45 of the sheet feeding cassette 15 to restrict the pulling out of the sheet feeding cassette 15 from the cassette housing part 13 and release the restriction. Since the handle 45 is configured to be turned by placing a finger from below, the finger can be securely placed even when the depth of the recess 41 housing the handle 45 is shallow.

In the locking mechanism 17, since the lock member 65 and the engagement portion 23 overlap in the front-and-rear direction, it is possible to reliably restrict the pulling out of the sheet feeding cassette 15 from the cassette housing part 13 by engaging them. The locking mechanism 17 is provided on the front side plate 3*a* of the apparatus main body 3 and the outer cover 33 of the sheet feeding cassette 15. In particular, the locking mechanism 17 is substantially within the depth of the recess 41 of the outer cover 33 (9 mm, in one example). Therefore, the locking mechanism 17 can be arranged in a narrow space.

Further, since the inclined surfaces 65*a* and 23*a* at which the lock member 65 and the engagement portion 23 are abutted when the sheet feeding cassette 15 is housed in the cassette housing part 13 are formed so as to guide the movement of the lock member 65, it becomes possible to smoothly move the lock member 65 and to engage it with the engagement portion 23. Further, since the inclined surfaces 61*a* and 65*b* at which the lock member 65 and the pin 61 are abutted when the handle 45 is turned into the housing posture are formed so as to guide the movement of the lock member 65, the lock member 65 can be smoothly moved.

Further, since the above-described description of the embodiments of the present disclosure describes the preferred embodiments of the image forming apparatus and the sheet feeding cassette according to the present disclosure, various technically preferable limitations may be added, but the technical scope of the present disclosure is not limited to these embodiments unless the description specifically limits the present disclosure.

The invention claimed is:

1. An image forming apparatus comprising:

sheet feeding cassette which is housed in an apparatus main body in a retractable manner, and a locking mechanism which restricts and releases a pulling out of the sheet feeding cassette from the apparatus main body, wherein the sheet feeding cassette includes:

an outer cover having a recess on an outer surface, and a handle which is housed in the recess so as to be turned outside from the outer surface, and turned outside by being gripped when the sheet feeding cassette is pulled out from the apparatus main body, and the locking mechanism restricts and releases the pulling out of the sheet feeding cassette from the apparatus main body in conjunction with the turning of the handle.

2. The image forming apparatus according to claim 1, wherein the locking mechanism includes:

a pin which is movably supported on the handle along a crossing direction intersecting a pulling out direction of the sheet feeding cassette, and is moved with the turning of the handle;

a pin biasing member which biases the pin in a protruding direction protruding from the handle;

a lock member which is disposed forward of the pin in the protruding direction and movably supported by the outer cover along the crossing direction;

a lock biasing member which biases the lock member in a direction opposite to the protruding direction; and an engagement portion which is provided in the apparatus main body and engageable with the lock member, wherein in a state where the sheet feeding cassette is housed in the apparatus main body, the pin is biased by the pin biasing member to push the lock member in the protruding direction against the biasing force of the lock biasing member, and the lock member is engaged with the engagement portion to restrict the pulling out of the sheet feeding cassette from the apparatus main body, and when the handle is gripped and turned when the sheet feeding cassette is pulled out from the apparatus main body, the pin is separated from the lock member, the lock member is biased by the lock biasing member and moved in the opposite direction to be separated from the engagement portion, and the sheet feeding cassette can be pulled out from the apparatus main body.

3. The image forming apparatus according to claim 1, wherein at least one of the engagement portion and the lock member has an inclined surface that abuts against the other of the engagement portion and the lock member when the sheet feeding cassette is housed in the apparatus main body, and when the inclined surface abuts against the other when the sheet feeding cassette is pushed into the apparatus main body, the lock member is guided by the inclined surface in the opposite direction.

4. The image forming apparatus according to claim 1, wherein at least one of the pin and the lock member has an inclined surface that abuts against the other of the pin and the lock member when the handle is housed in the recess, and when the inclined surface abuts against the other when the handle is housed in the recess, the lock member is guided in the protruding direction by the inclined surface.

* * * * *